United States Patent [19]

Gann

[11] 4,319,703

[45] Mar. 16, 1982

[54] NEEDLEWORK THREAD HOLDER AND ORGANIZER

[76] Inventor: Bonnie L. Gann, P.O. Box 338, Stockbridge, Ga. 30281

[21] Appl. No.: 126,685

[22] Filed: Mar. 3, 1980

[51] Int. Cl.[3] ..... A41H 31/00

[52] U.S. Cl. ..... 223/106; 40/10 D; 40/159; 206/388; 206/574; 223/109 R

[58] Field of Search ..... 223/106, 107, 108, 109 R, 223/109 A; 206/223, 574, 388, 425; 229/87.5; 40/10 D, 159

[56] References Cited

U.S. PATENT DOCUMENTS

| | | | |
|---|---|---|---|
| 650,630 | 5/1900 | Chamberlain | 206/388 |
| 958,218 | 5/1910 | Benze | 206/574 X |
| 1,705,050 | 3/1929 | Taylor | 229/87.5 X |
| 2,540,340 | 2/1951 | Linblade | 223/109 A |
| 2,646,196 | 7/1953 | York | 206/388 X |
| 3,851,762 | 12/1974 | Liblick | 206/425 |
| 3,857,484 | 12/1974 | Thyen | 229/87.5 X |
| 4,065,864 | 6/1978 | Stanley | 40/159 X |
| 4,196,536 | 4/1980 | Westberg | 40/159 |

*Primary Examiner*—Louis Rimrodt

*Attorney, Agent, or Firm*—Newton, Hopkins & Ormsby

[57] ABSTRACT

A ring notebook carries a flexible, rectangular, opaque base sheet provided along one longitudinal side with spaced holes through which the rings of the notebook protrude. One surface of the base sheet is provided with a smaller, transparent, rectangular yarn retaining sheet secured to the base sheet along the upper and lower borders of the retaining sheet by a pair of straight, parallel, heat sealed, transversely extending end securing strips. Between the end securing strips are a plurality of equally spaced, transversely extending parallel, heat sealed divider strips, the divider strips and the end strips separating the retaining sheet into a plurality of transversely disposed, open ended pockets which receive skeins of yarn.

13 Claims, 5 Drawing Figures

NEEDLEWORK THREAD HOLDER AND ORGANIZER

BACKGROUND OF THE INVENTION

1. Field of the Invention

This invention relates to a needlework thread holder and organizer and is more particularly concerned with an apparatus which holds skeins of yarn accessible by a user for needlework.

2. Background of the Invention

In the past, skein holders have been devised. One such skein holder is illustrated in U.S. Pat. No. 650,630. The device depicted in this patent includes a cover and leaves bound along a common edge, the leaves having slits which retain either the yarn or cards containing yarn. The holder is arranged as a book so that several yarns are in juxtaposition for access.

U.S. Pat. No. 1,705,050 discloses another form of holder wherein filaments are arranged on a sheet, being strapped therein by housings formed of fabric strips with tongues that pass through openings in the strips for securing the fabric strips together.

U.S. Pat. No. 2,646,196 discloses a device for holding embroidery floss and textile weaving and sewing material. The structure includes a loose leaf binder with cutout portions for carrying the yarn and with sheets which form pockets. Soft textile material is secured to the sheets for retaining the needles.

U.S. Pat. No. 3,851,762 and 3,857,484 were also revealed by a preliminary search conducted by the applicant. The devices shown therein are not considered to be particularly pertinent.

The present invention provides an inexpensive construction which will carry a plurality of yarns in juxtaposition for simultaneous viewing and, at the same time, provides indicia receiving means on which the symbols for the respective yarns can be temporarily written. Such a means also functions to receive lengths of yarn when not being used. The present invention also provides pockets by which additional lengths of yarn can be stored for appropriate identification with the original skeins of yarn stored in a main pocket.

SUMMARY OF THE INVENTION

Briefly described, the present invention includes a ring binder or loose leaf binder which carries one or a plurality of flexible, rectangular, opaque or clear base sheets provided along one longitudinal side with spaced holes through which rings of the notebook protrude. One surface of the base sheet receives a smaller transparent, rectangular yarn retaining sheet secured to the base sheet along the upper and lower borders of the retaining sheet by a pair of heat sealed transversely extending end securing strips. Additional strips which are disposed parallel to each other in longitudinally spaced relationship divide the yarn retaining sheet into a plurality of main open ended, transversely extending yarn receiving pockets.

Aligned with these main pockets but on one side of the base sheet are additional second and third pockets which are superimposed upon each other, the second and third pockets being formed by a pair narrow sheets, one sheet being narrower than the other sheet, the two sheets being disposed one upon the other. Horizontal strips aligned with the strips of the yarn retaining sheet secure the two narrower transparent sheets together, providing sidewise opening pockets between the two and also secure the bottom sheet to the base sheet.

A thin longitudinally extending opaque strip extends across the central portion of the yarn retaining sheet and provides erasable indicia receiving means by which the symbols of a pattern may be written over the appropriate yarn retained by the yarn retaining sheet. This erasable strip also serves a second function of providing a means around which strands of yarn can be temporarily looped. The side pockets formed by the narrower sheets also permits strands of yarn to be retained in the appropriate location adjacent to the yarn skeins carried by the yarn retaining sheet. The top side pockets are for receiving the needles.

In the second embodiment of the invention, the erasable strip, instead of being secured at its upper and lower ends by heat sealing, is secured by means of tabs. Magnetic sheets or felt sheets are substituted for the narrower sheet forming the top side pocket to receive the needles.

On the back side of the main or base sheet is a large sidewise or lengthwise opening pocket formed by a transparent sheet, the pocket being adapted to receive the chart of the needlework and also to carry a hook member which is employed for drawing the yarn into the main pockets.

Accordingly, it is an object of the present invention to provide a needlework thread holder and organizer which is inexpensive to manufacture, durable in structure and efficient in operation.

Another object of the present invention is to provide a needlework thread holder and organizer which is particularly suited for use with needlework charts, providing areas by which the yarns may be identified with the chart and storage areas by which the yarns may be readily and easily retrieved for further work when the chart requires.

Another object of the present invention is to provide a needlework thread holder and organizer which will hold a substantial quantity of yarns of different characteristics such as color and size and which will present these yarns for ready access.

Another object of the present invention is to provide a needlework thread holder and organizer which will provide facilities for the temporary storage of strands of yarn and also for the temporary storage of needles according to the yarn which the needles carry.

Other objects, features and advantages of the present invention will become apparent from the following description when taken in conjunction with the accompanying drawings wherein like characters of reference designate corresponding parts throughout the several views.

DETAILED DESCRIPTION OF THE PREFERRED EMBODIMENTS

Figure 1:
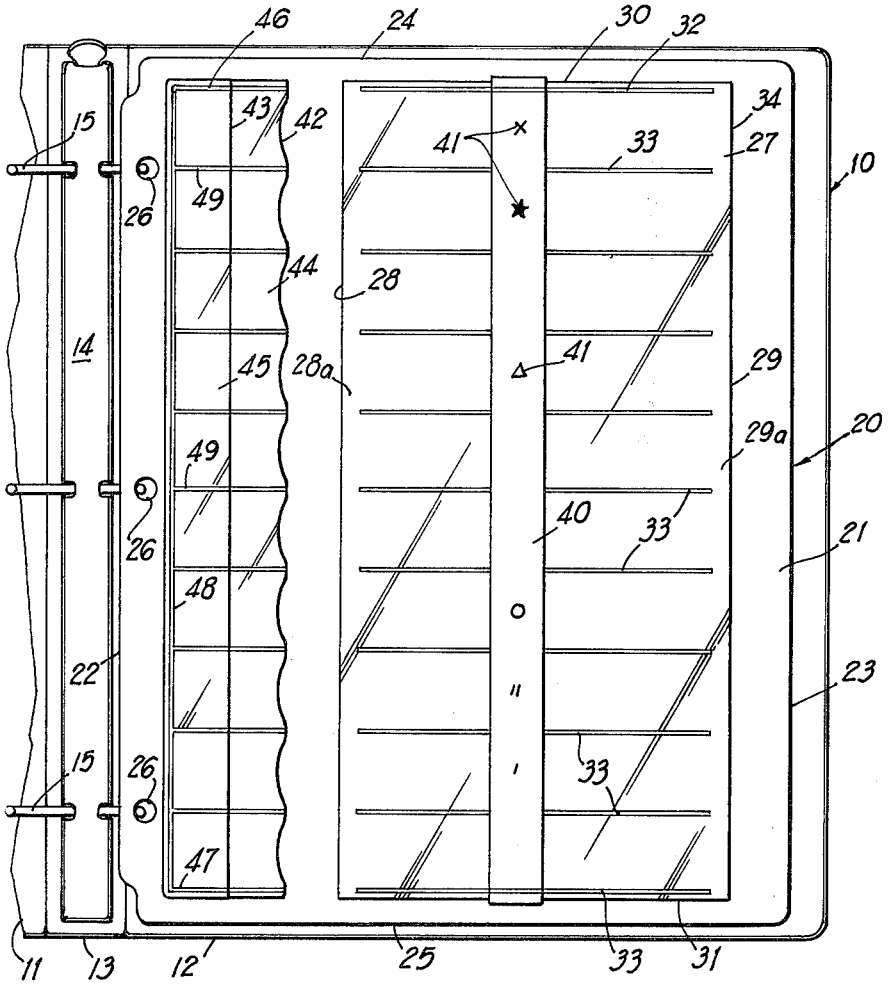
FIG. 1 is a fragmentary plane view of a needlework thread holder and organizer constructed in accordance with the present invention.
Figure 2:
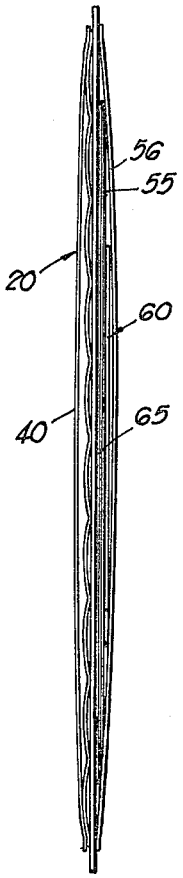
FIG. 2 is a side elevational view of the front of one page of the holder depicted in FIG. 1.

Referring now in detail to the embodiments chosen for the purpose of illustrating the present invention, numeral 10 in FIG. 1 denotes generally a loose leaf notebook or binder having a front cover 11, a back cover 12 joined along a common ring carrying spine 13. The notebook 10 may be in zipper up carrying case form, if desired. Mounted on the front surface of this spine 13 is a ring member 14 having three longitudinally spaced rings 15. The structure thus far described is essentially conventional and found in the usual loose leaf notebook.

According to the present invention, the loose leaf notebook is provided with a plurality of yarn holding members which form pages in the notebook, such as the yarn holding member denoted generally by the numeral 20. Each yarn holding member 20 includes a generally translucent or opaque, thermoplastic rectangular base sheet 21 having an inner longitudinal edge 22, and an outer longitudinal edge 23 disposed vertically parallel to each other. The sheet 21 also has an upper transversely extending edge 24 and a lower transversely extending edge 25, the edges 24 and 25 being parallel to each other and perpendicular to the edges 22 and 23. Adjacent to the inner edge 22, the sheet 21 is provided with longitudinally spaced holes 26 which correspond in number and location to the rings 15, the sheet 21 being installed on the rings 15 in the usual manner by having the rings protrude through the holes 26.

Disposed over a portion of one surface of the sheet 21 is a smaller, transparent, thermoplastic, rectangular, yarn retaining sheet 27 which has a straight longitudinally extending inner edge 28 and a straight longitudinally extending outer edge 29 disposed parallel to each other and also parallel to the longitudinal edges 22 and 23. The outer edge 29 is inwardly adjacent the outer edge 23 while the inner edge 28 is spaced from the, but parallel to the inner edge 22. The yarn retaining sheet 27 also includes an upper transversely extending edge 30 inwardly adjacent the edge 24 and a transversely extending lower edge 31 inwardly adjacent the edge 25. The transverse edges 30 and 31 are respectively joined by heat sealing to the front surface of sheet 21, the heat sealing being in the form of straight longitudinally extending parallel strips 32 and 33 which form fastening means joining the sheets 21 and 27.

Inwardly of the strips 32 and 33, the thread or yarn retaining sheet 27 is heat sealed to the front surface sheet 21 at vertically spaced locations by means of parallel straight strips 33. The strips 33 extend from positions inwardly of both edge 28 and edge 29 and are evenly spaced apart to provide juxtaposed vertically aligned and horizontally disposed yarn receiving pockets 34 which are open at both of its ends inwardly of edges 27 and 28 to leave edge yieldable, flexible flaps **27*a* and 28*a* inwardly of edges 27 and 28. These juxtaposed, transversely extending parallel main pockets 34 form open-ended members which are adapted to receive skeins 36 of yarn or threads. These skeins 36 of yarn when purchased are usually of a given length, about 6 inches long but may vary in length. The distance between the edges 28 and 29 is about $5\frac{1}{4}$ inches so that the skeins 36 of yarn protrude from both ends of each of the pockets. These skeins 36 of yarn are provided with wrappers 37 and 38, the wrapper 37 extending around a portion of the yarn to indicate the color by indicia 39. These indicia 39 being readily read through the transparent sheet 27, as can information contained on the wrapper 38 which is spaced from the wrapper 37**.

It will be found desirable at times to remove the wrappers 37 and 38 for more readily access to the yarn contained in the pocket. Even with the wrappers 37 and 28 removed, the yarn will readily stay in the pocket and may be elongated so that yarn can be looped over the surface of the sheet 27 and through the pocket, thereby provided ready access to any strands within the skein as illustrated at numeral 39.

Extending over the central portion of the sheet 27 is a narrow rectangular generally opaque or translucent, erasable, recording strip 40, the purpose of which is to provide any other surface on which appropriate indicia 41 may be written with a pencil so as to indicate the chart symbol of chart 65 which designates the color of the particular skein 36 which is disposed in the pocket therebelow. Such symbols as "x", "o", "z", "*", "+", "Δ", "*", "6", "..", "." are normally used on charts 65 for indicating yarns in the pattern.

Between the holes 26 and the edge 28 there are provided smaller sidewise opening pairs of second and third pockets 42 and 43 which are in horizontal or transverse alignment respectively with the pockets 34. These pockets 42 and 43 are formed by a pair of overlapping or superimposed rectangular, transparent, thermoplastic side pocket forming sheets 44 and 45. The bottom sheet 44 is wider than the top sheet 45 so that the outer pocket 43 is approximately one half of the depth of the inner pocket 42. The sheet 45 is disposed on top of and extends over the outer half of the sheet 44. Heat sealing strip 46 which aligned with and spaced from the strip 32 seals the upper edges of the sheets 44 and 45 together and also seal the sheet 44 to the surface of sheet 21. The bottom transversely extending heat seal strip 47 seals the lower edge portion of the sheets 44 and 45 together and seals the sheet 45 to the sheet 21. A vertically or longitudinally extending strip 48 which passes adjacent the holes 26 join the outer edges of sheets 44 and 45 to each other and join the outer edge of sheet 44 to the sheet 21. Heat seal strips 49 are respectively aligned transversely with the strips 33 and are parallel to and spaced from each other, being parallel to and inwardly of the strips 46 and 47 for forming the inner sides of the pockets 42 and 43.

Figure 3:
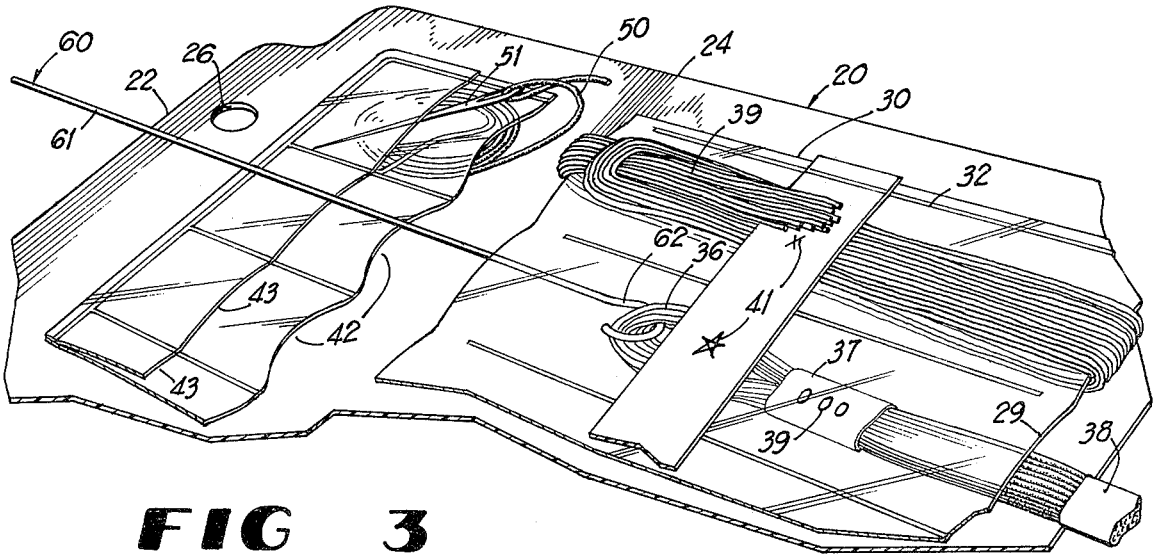
FIG. 3 is a enlarged fragmentary prospective view of a portion of the holder depicted in FIGS. 1 and 2 being utilized for receiving a skein of yarn being drawn into a main pocket by a hook member.
Figure 4:
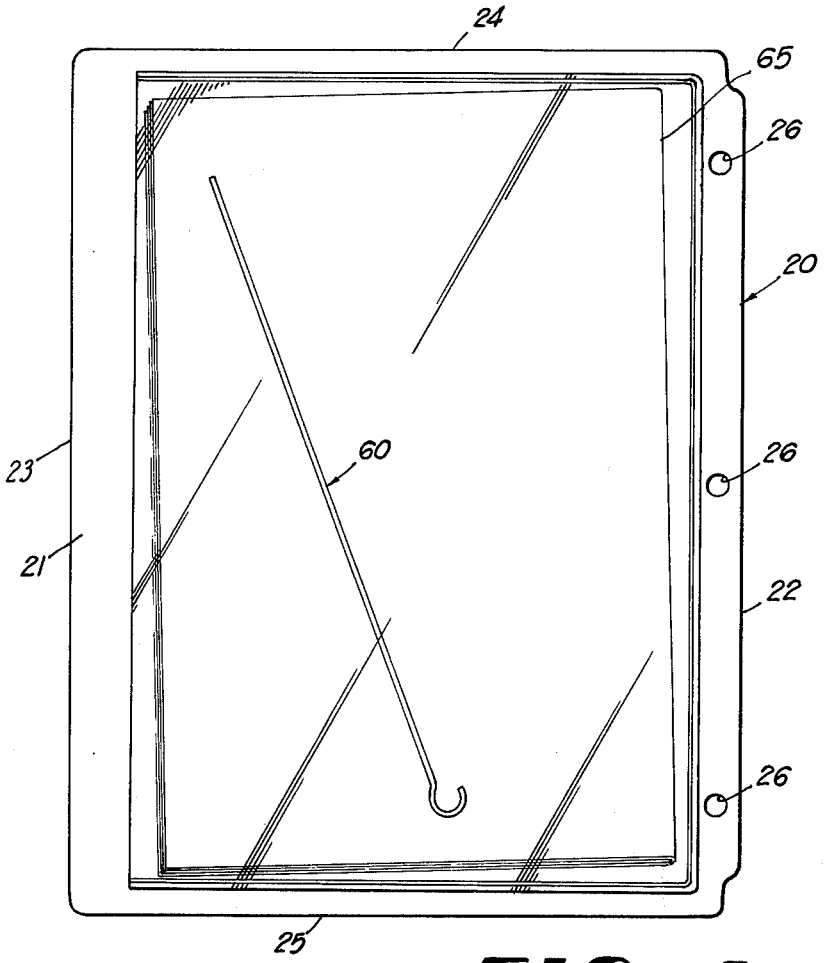
FIG. 4 is a side elevational view of the back of the page shown in FIG. 2.

As seen in FIG. 3, the inner sidewise opening pocket 42 is particularly adapted to receive individual strands or lengths of yarn or thread 50 while the outer and shorter sidewise opening pocket 43 is adapted to receive one or a plurality of needles 51. The yarn 50 of a particular size and color is usually aligned with the main pocket 34 which contains the particular skein of that yarn. Therefore, the symbol 41 which designates the skein of yarn will also designate the strand 50.

On the back side of the sheet 21 there is a single large sidewise or lengthwise opening pocket 55 formed by a transparent sheet 56 heat sealed at its top edge, bottom edge and inner edge to the back surface of sheet 21. This pocket 55 provides a convenient place to store a chart 65 for making the needlework. It also is a convenient place to store a hook member 60 which is employed, as illustrated in FIG. 3 for pulling the skein 36 of yarn into the main pocket 34. This hook member 60 is made preferably of metal such as coat hanger wire and includes a straight shank 61 which is longer than the length of the pocket 34 and an open generally U-shaped hook 62. When the hook member 60 is employed, it is inserted through an empty pocket 34 and then one end of the skein of yarn 36 is looped over the hook and the hook member 60 retracted so as to draw the skein 36 into the pocket 34. The skein 36 is properly positioned when the ends of the skein protrude from both ends of the pocket 34.

Figure 5:
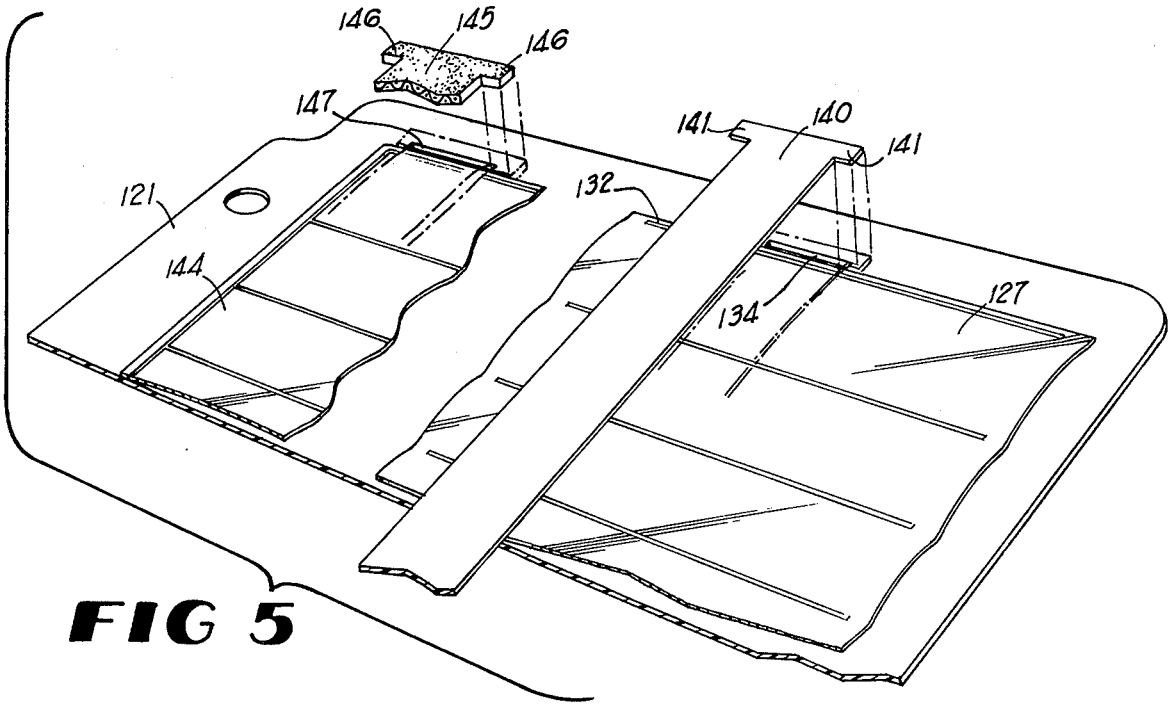
FIG. 5 is a fragmentary exploded prospective view of a second embodiment of the present invention.

In the embodiment shown in FIG. 5, a removable, longitudinally disposed, erasable, indicia receiving strip 140 is substituted for the strip 40 of the first embodiment. Instead of being heat sealed to the sheet 27, the ends of the rectangular strip 140 are provided with opposed sidewise extending tabs 141 which widen or enlarge the strip 140 at its ends to form tees. Closely adjacent and parallel to the outer transverse sealing strips, such as strip 132, which seal the edges of yarn retaining sheet 127 to base sheet 121 there is provided a transverse slit or window 134 in sheet 121, the window 134 being approximately the width of strip 140 and shorter than the width at the ends of strip 140. Thus, the end portion of strip 140, when inserted through windows 134 and beneath sheet 121 is retained in place, as illustrated by broken lines in FIG. 5. The other end of strip 140 is similarly attached so that the strip 140 is retained, outwardly of the top and bottom edges of sheet 127.

In FIG. 5 is also illustrated an alternate form of needle holding means which is substituted for the sheet 45. This means includes a longitudinally extending, flexible felt fabric or flexible magnetic strip 145 having sidewise extending tabs 146 at its end portions. Base sheet 121 is provided with slits or windows, such as slit 147 similar to slit 134 the slits being outwardly of the top and bottom edges of sheet 144. The end portions of strip 145 extend through these slits, such as slit 147 so that the tabs 146 are below sheet 121 and the body of strip 145 extends over sheet 144. Needles (not shown) inserted into the felt or placed on the magnetic strip are removably retained thereon. Otherwise the strip 145 functions in the same manner as strip 45.

It is understood that, while in the preferred embodiments I have described the heat sealing of sheet 27 to sheet 21 and sheets 44 and 45 to each other and sheet 44 to sheet 21, and sheet 56 to the back side of sheet 21, stitching (not shown) or any other means of securing the appropriate portions of the respective sheets together may be employed without departing from the scope of the present invention. Also, the main pockets 34 and the auxiliary sidewise pockets 42 and 43 may be varied in size, so as to accomodate larger or smaller yarn.

It will be obvious to those skilled in the art that many variations may be made in the embodiments here chosen for the purposes of illustrating the present invention without departing from the scope thereof as defined by the appended claims.

I claim:

1. A needlework thread or yarn holder comprising a base sheet, a yarn retaining sheet disposed over said base sheet, said base sheet being larger than said yarn retaining sheet and said yarn retaining sheet being disposed within the confines of said base sheet, strips disposed in spaced, parallel, transverse relationship securing said yarn retaining sheet to said base sheet, said strips defining with said base sheet and said yarn retaining sheet a plurality of transversely extending parallel main pockets, opened at their ends for receiving and retaining yarn skeins respectively therein, and indicia receiving means carried by one of the sheets in a position adjacent to a plurality of said pockets for receiving symbol markings which respectively designate the yarn of said skeins in the respective pockets, said indicia receiving means and said yarn retaining sheet being on the same side of said base sheet whereby they may be simultaneously observed.

2. The thread holder defined in claim 1 including a second sheet disposed on the surface of said base sheet in spaced relationship to said yarn retaining sheet and means securing said second sheet to said base sheet for forming second pockets respectively aligned with the pockets of said yarn retaining sheet.

3. The holder defined in claim 2 wherein said second pockets and said main pockets open sidewise toward each other, said second pockets being for receiving yarns therein.

4. The holder defined in claim 3 including a third sheet disposed over said second sheet and providing sidewise opening pockets aligned transversely with said yarn retaining pockets.

5. The holder defined in claim 3 including an additional sheet on the surface of said base sheet opposite to the surface containing said yarn retaining sheet, said additional sheet forming an additional pocket.

6. The holder defined in claim 2 including a needle retaining strip carried by said base sheet and extending over the pockets of said second sheet and adjacent to the openings of said second sheet for receiving needles and for retaining them adjacent to the respective second pockets of said second sheet.

7. The holder defined in claim 6 wherein said needle retaining strip is a magnetic means for magnetically retaining needles.

8. The holder defined in claim 1 wherein said indicia receiving means is an erasible strip secured by its ends to said yarn retaining strip.

9. The holder defined in claim 1 wherein said yarn retaining sheet included spaced opposed flexible longitudinal side flaps along the side edge portions of said yarn retaining sheet, said flaps being yieldably foldable outwardly to facilitate access to the pockets of said yarn retaining sheet.

10. The holder defined in claim 1 including hook means for pulling yarn into and through said main pockets.

11. The holder defined in claim 1 including a book having ring binders at spaced locations, one edge of said base sheet being provided with holes which receive said rings respectively.

12. A needlework thread or yarn holder comprising a base sheet, a transparent yarn retaining sheet over said base sheet, and fastening means for securing said yarn retaining sheet to said base sheet, said yarn retaining sheet defining with said fastening means and said base sheet a plurality of vertically aligned transversely extending sidewise opening pockets open on both ends, a second yarn retaining sheet sidewise of and in juxtaposition to the first mentioned yarn retaining sheet and second fastening means for securing said second retaining sheet to said base sheet, said fastening means and base sheets, and said second yarn retaining sheet defining sidewise opening pockets transversely aligned with said pockets of said first mentioned yarn retaining sheet.

13. The holder defined in claim 12 including an indicia receiving strip substantially narrower than said yarn retaining sheet extending vertically across the surface of said yarn retaining sheet, said strip having a surface on which markings are placed to identify skeins of yarn in the pockets of said yarn retaining sheet.

* * * * *